US009683195B2

(12) United States Patent
Nakada et al.

(10) Patent No.: US 9,683,195 B2
(45) Date of Patent: Jun. 20, 2017

(54) VISCOSITY INDEX IMPROVER AND LUBRICATING OIL COMPOSITION

(71) Applicant: SANYO CHEMICAL INDUSTRIES, LTD., Kyoto (JP)

(72) Inventors: Shigekuni Nakada, Kyoto (JP); Ayumu Sakaguchi, Kyoto (JP); Takenori Tatsumi, Kyoto (JP); Hiroki Yamashita, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 15/117,883

(22) PCT Filed: Feb. 25, 2015

(86) PCT No.: PCT/JP2015/055358

§ 371 (c)(1),
(2) Date: Aug. 10, 2016

(87) PCT Pub. No.: WO2015/129732

PCT Pub. Date: Sep. 3, 2015

(65) Prior Publication Data

US 2017/0009177 A1 Jan. 12, 2017

(30) Foreign Application Priority Data

Feb. 25, 2014 (JP) ..... 2014-034579

(51) Int. Cl.

| | |
|---|---|
| ***C10M 133/56*** | (2006.01) |
| ***C10M 145/14*** | (2006.01) |
| ***C10M 149/04*** | (2006.01) |
| ***C10M 149/10*** | (2006.01) |
| ***C10M 153/02*** | (2006.01) |

(52) U.S. Cl.

CPC ..... *C10M 145/14* (2013.01); *C10M 149/04* (2013.01); *C10M 149/10* (2013.01); *C10M 153/02* (2013.01); *C10M 2209/084* (2013.01); *C10M 2217/022* (2013.01); *C10M 2217/028* (2013.01); *C10M 2225/02* (2013.01); *C10N 2220/021* (2013.01); *C10N 2220/022* (2013.01); *C10N 2230/02* (2013.01); *C10N 2230/06* (2013.01); *C10N 2230/10* (2013.01); *C10N 2230/12* (2013.01); *C10N 2230/18* (2013.01); *C10N 2230/70* (2013.01); *C10N 2240/042* (2013.01); *C10N 2240/044* (2013.01); *C10N 2240/045* (2013.01)

(58) Field of Classification Search

CPC ..... C10M 2217/06; C10M 2215/04
USPC ..... 508/292
See application file for complete search history.

(56) References Cited

U.S. PATENT DOCUMENTS

| | | | |
|---|---|---|---|
| 2008/0194443 | A1 | 8/2008 | Stohr et al. |
| 2010/0190671 | A1 | 7/2010 | Stoehr et al. |

FOREIGN PATENT DOCUMENTS

| | | | |
|---|---|---|---|
| JP | 03-143996 | 6/1991 | |
| JP | 08-169922 | 7/1996 | |
| JP | 2732187 | 3/1998 | |
| JP | 2754343 | 5/1998 | |
| JP | 3474918 | 12/2003 | |
| JP | 2005-200454 | 7/2005 | |
| JP | 3831203 | 10/2006 | |
| JP | 3999307 | 10/2007 | |
| JP | 2008-546894 | 12/2008 | |
| JP | 2010-532805 | 10/2010 | |
| JP | WO 2012081180 A1 * | 6/2012 | ..... C10M 145/14 |
| JP | 2013-133460 | 7/2013 | |
| JP | 2013-147608 | 8/2013 | |

OTHER PUBLICATIONS

JETI, "Koseino Nendo Shisu Kojozai no Gijutsu Kaihatsu", vol. 57, No. 11, 2009, pp. 188-192, cited in ISR.
Robert F. Fedors, "A Method for Estimating Both the Solubility Parameters and Molar Volumes of Liquids", Polymer Engineering and Science, vol. 14, No. 2, 1974, pp. 147-152.
Marika Joona, "Solubility the Most Important Property—But Difficult to Measure", SP Nynas, cited in Third Party Observation filed Jun. 2, 2016 in JP Application No. 2016-505254.
Charles H. Fisher, "Solubility Parameters of Oil and Fat Chemicals", JAOCS, vol. 78, No. 2, 2001, pp. 215-216.
International Preliminary Report on Patentability issued May 19, 2015 in corresponding (PCT) Application No. PCT/JP2015/055358.
International Search Report issued May 19, 2015 in corresponding (PCT) Application No. PCT/JP2015/055358.

* cited by examiner

*Primary Examiner* — Vishal Vasisth
(74) *Attorney, Agent, or Firm* — Wenderoth, Lind & Ponack, L.L.P.

(57) ABSTRACT

The present invention aims to provide a viscosity index improver excellent in shear stability and having a low HTHS viscosity and a high viscosity index. The viscosity index improver of the present invention contains a (co)polymer (A) containing a polyolefin-based monomer as an essential monomer unit, and a base oil, wherein the absolute value of difference in solubility parameter between the (co)polymer (A) and the base oil is 0.8 to 2.0 $(cal/cm^3)^{1/2}$.

12 Claims, No Drawings

VISCOSITY INDEX IMPROVER AND LUBRICATING OIL COMPOSITION

This application is a 371 of PCT/JP2015/055358, filed Feb. 25, 2015.

TECHNICAL FIELD

The present invention relates to a viscosity index improver and a lubricating oil composition containing the viscosity index improver.

BACKGROUND ART

A demand for lower fuel consumption of vehicles is increasing in recent years for the purposes such as a reduction in the amount of $CO_2$ emissions and protection of oil resources. For example, one approach to lower the fuel consumption is to reduce the viscous resistance of an engine oil by lowering its viscosity. However, lower viscosity causes problems such as oil leakage and seizure. In cold regions, startability at low temperatures is required. With regard to these issues, the US Society for Automotive Engineering (SAE) specifies the viscosity in the standard for Engine Oil Viscosity Classification (SAE J300). For 0W-20 grade oil, the high temperature high shear (HTHS) viscosity at 150° C. (ASTM D4683 or D5481) is specified to be Min. 2.6. In addition, for the same grade oil, the low temperature viscosity at −40° C. is specified to be 60,000 mPa·s or less with no yield stress (ASTM D4684) in order to ensure startability in cold regions. To lower the fuel consumption, there is a demand for an engine oil that satisfies the above standard and has a lower HTHS viscosity in the effective temperature at 80° C. or 100° C., and various viscosity index improvers have been suggested. Known examples of such viscosity index improvers include a methacrylic acid ester copolymer (Patent Literatures 1 to 4), an olefin copolymer (Patent Literature 5), and a comb copolymer (Patent Literatures 6 to 8).

However, these viscosity index improvers are insufficient in reducing the HTHS viscosity at 80° C. when added to an engine oil composition. Such an engine oil composition is susceptible to the viscosity reduction due to shear and exhibits a viscosity increase at low temperatures.

CITATION LIST

Patent Literature

Patent Literature 1: JP-B 2732187
Patent Literature 2: JP-B 2754343
Patent Literature 3: JP-B 3831203
Patent Literature 4: JP-B 3999307
Patent Literature 5: JP-A 2005-200454
Patent Literature 6: JP-B 3474918
Patent Literature 7: JP-T 2008-546894
Patent Literature 8: JP-T 2010-532805

SUMMARY OF INVENTION

Technical Problem

The present invention aims to provide a viscosity index improver having excellent shear stability, a low HTHS viscosity in the effective temperature range, and a high viscosity index; and a lubricating oil composition containing the same.

Solution to Problem

As a result of intensive studies, the present inventors arrived at the present invention. Specifically, the present invention relates to a viscosity index improver containing a (co)polymer (A) containing a polyolefin-based monomer as an essential monomer unit and a base oil, wherein the absolute value of difference in solubility parameter between the (co)polymer (A) and the base oil is 0.8 to 2.0 $(cal/cm^3)^{1/2}$. The present invention also relates to a lubricating oil composition containing the viscosity index improver and at least one additive selected from the group consisting of a detergent, a dispersant, an antioxidant, an oiliness improver, a friction and wear modifier, an extreme pressure additive, a defoamer, a demulsifier, and a corrosion inhibitor.

Advantageous Effects of Invention

The viscosity index improver of the present invention and the lubricating oil composition containing the same provides effects such as excellent shear stability, a low HTHS viscosity in the effective temperature range, and a high viscosity index.

DESCRIPTION OF EMBODIMENTS

The viscosity index improver of the present invention contains a (co)polymer (A) containing a polyolefin-based monomer as an essential monomer unit and a base oil, wherein the absolute value of the difference in solubility parameter between the (co)polymer (A) and the base oil is 0.8 to 2.0 $(cal/cm^3)^{1/2}$.

The (co)polymer (A) of the present invention is a (co) polymer containing a polyolefin-based monomer as an essential monomer unit.

The polyolefin-based monomer of the present invention is a monomer obtained by modifying a hydrocarbon polymer (described later) and reacting the modified hydrocarbon polymer with (meth)acrylic acid. The term "(meth)acryl" means methacryl or acryl.

Forms of modification include, for example, introduction of a hydroxyl group into a hydrocarbon polymer and introduction of an amino group into a hydrocarbon polymer. Specific examples include a monomer that can be obtained by esterification of a hydroxyl group-containing (co)polymer obtained by introducing a hydroxyl group into a hydrocarbon polymer [such as a hydroxyl group-containing polymer obtained by introducing a hydroxyl group into a hydrogenated polybutadiene or polybutene] with (meth) acrylic acid; and a monomer that can be obtained by amidation of an amino group-containing (co)polymer obtained by introducing an amino group into a hydrocarbon polymer with (meth)acrylic acid. In terms of HTHS viscosity and viscosity index, the number of hydroxyl groups or amino groups in the modified hydrocarbon polymers is preferably one.

The hydrocarbon polymer is a polymer containing the following hydrocarbons (1) to (3) as monomer units. The hydrocarbon polymer may be a block polymer or random polymer. If the hydrocarbon polymer has a double bond, the double bond may be partially or completely hydrogenated by hydrogenation.

(1) Aliphatic unsaturated hydrocarbons [such as C2-C36 olefins (e.g., ethylene, propylene, isobutene, 1-butene, 2-butene, pentene, heptene, diisobutylene, octene, dodecene, octadecene, triacontene, and hexatriacontene), and C2-C36 dienes (e.g., 1,2-butadiene, 1,3-butadiene, isoprene, 1,4-pentadiene, 1,5-hexadiene, and 1,7-octadiene)]

(2) Alicyclic unsaturated hydrocarbons [e.g., cyclohexene, (di)cyclopentadiene, pinene, limonene, indene, vinylcyclohexene, and ethylidenebicycloheptene]

(3) Aromatic group-containing unsaturated hydrocarbons (e.g., styrene, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, vinylnaphthalene, divinylbenzene, divinyltoluene, divinylxylene, and trivinylbenzene), and the like.

In terms of HTHS viscosity and viscosity index, aliphatic unsaturated hydrocarbons are preferred among these monomers, with C2-C36 olefins and C2-C36 dienes being more preferred, C2-C16 olefins and C2-C10 dienes being still more preferred, and isobutene, 1-butene, 2-butene, and 1,3-butadiene being particularly preferred.

In terms of shear stability and HTHS viscosity, the number average molecular weight (hereinafter abbreviated to Mn) of the polyolefin-based monomer is preferably 1,000 to 25,000, more preferably 1,500 to 20,000, particularly preferably 2,000 to 15,000, most preferably 2,500 to 10,000.

The Mn of the polyolefin-based monomer and the weight average molecular weight (hereinafter abbreviated to Mw) of a (co)polymer (A) (described later) can be measured by gel permeation chromatography under the following conditions.

<Conditions for Measurement of Mn of the Polyolefin-Based Monomer and Mw of the (Co)Polymer (A)>

Device: "HLC-802A" [Tosoh Corporation]

Column: "TSK gel GMH6" [Tosoh Corporation] two columns

Measurement temperature: 40° C.

Sample solution: 0.5% weight solution in tetrahydrofuran

Amount of solution injected: 200 μl

Detector: Refractive index detector

Standard substance: standard polystyrene (TSK standard polystyrene) 12 samples (molecular weight: 500, 1,050, 2,800, 5,970, 9,100, 18,100, 37,900, 96,400, 190,000, 355,000, 1,090,000, and 2,890,000) [Tosoh Corporation]

In terms of HTHS viscosity and viscosity index, the polyolefin-based monomer is preferably a monomer (a) represented by the following formula (1):

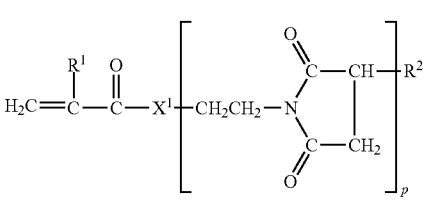

(1)

wherein $R^1$ is a hydrogen atom or a methyl group; —$X^1$— is a group represented by —O—, —$O(AO)_m$—, or —NH— in which A is a C2-C4 alkylene group, m is an integer of 0 to 10, each A may be the same or different when m is 2 or more, and the $(AO)_m$ moieties may be randomly bonded or block-bonded; $R^2$ is a residue in which one hydrogen atom is removed from a hydrocarbon polymer containing at least one of isobutylene or 1,2-butylene as an essential structural unit; and p is a number of 0 or 1.

In the formula (1), $R^1$ is a hydrogen atom or a methyl group. In terms of HTHS viscosity in the effective temperature range, a methyl group is preferred between these.

In the formula (1), —$X^1$— is a group represented by —O—, —$O(AO)_m$—, or NH—.

A is a C2-C4 alkylene group.

Examples of the C2-C4 alkylene group include an ethylene group, a 1,2- or 1,3-propylene group, and 1,2-, 1,3-, or 1,4-butylene group.

In addition, m is an integer of 0 to 10. In terms of HTHS viscosity in the effective temperature range, it is preferably an integer of 0 to 4, more preferably 0 to 2.

In the case where m is 2 or more, each A may be the same or different, and the $(AO)_m$ moieties may be randomly bonded or block-bonded.

In terms of HTHS viscosity in the effective temperature range, the group represented by —$X^1$— is preferably a group represented by —O— or —$O(AO)_m$—, and it is more preferably a group represented by —O— or —$O(CH_2CH_2O)$—.

In addition, p is a number of 0 or 1.

In the formula (1), $R^2$ is a residue in which one hydrogen atom is removed from a hydrocarbon polymer containing at least one of isobutylene or 1,2-butylene as an essential structural unit.

Examples of the hydrocarbon polymer containing at least one of isobutylene or 1,2-butylene as a structural unit include a polymer containing isobutene, 1-butene, and 2-butene as structural units, and a polymer obtained by hydrogenating the terminal double bond of a 1,2-adduct of poly(1,3-butadiene).

The hydrocarbon polymer may be a block polymer or a random polymer.

The hydrocarbon polymer containing at least one of isobutylene or 1,2-butylene as an essential structural unit may further contain a structural unit other than at least one of isobutylene or 1,2-butylene. Examples of such monomer units include the aliphatic unsaturated hydrocarbons (1), the alicyclic unsaturated hydrocarbons (2), and the aromatic group-containing unsaturated hydrocarbons (3), other than isobutene, 1-butene, and 2-butene. If the hydrocarbon polymer has a double bond, the double bond may be partially or completely hydrogenated by hydrogenation.

In terms of HTHS viscosity, viscosity index, and shear stability, the total number of at least one of isobutylene or 1,2-butylene based on the total number of structural units of the hydrocarbon polymer is preferably 30 mol % or more, more preferably 40 mol % or more, particularly preferably 50 mol % or more, most preferably 60 mol % or more.

The total number of isobutylene and 1,2-butylene based on the total number of structural units of the hydrocarbon polymer can be determined by analyzing the hydrocarbon polymer by 13C-nuclear magnetic resonance spectroscopy and using the following equation (1). The 13C-nuclear magnetic resonance spectrum has a peak derived from a methyl group of isobutylene at 30-32 ppm integral value (integral value A), and a peak derived from a branched methylene group (—$CH_2$—$CH(CH_2CH_3)$—) of 1,2-butylene at 26-27 ppm integral value (integral value B). The total number of isobutylene and 1,2-butylene can be determined from the integral values of the peaks and an integral value (integral value C) of peaks for all carbon atoms of the hydrocarbon polymer.

[Math 1]

$$\text{Total content of isobutylene and 1, 2-butylene} = \frac{(\text{Integral value } A)\times 2 + (\text{Integral value } B)\times 4}{(\text{Integral value } C \text{ of peaks for all carbon atoms})}\times 100 \quad (1)$$

The monomer (a) represented by the formula (1) can be obtained by esterification or amidation of a hydroxyl group-containing (co)polymer obtained by introducing a hydroxyl group into a hydrocarbon polymer or an amino group-containing (co)polymer obtained by introducing an amino group into a hydrocarbon polymer with (meth)acrylic acid.

Specific examples of the (co)polymers (Y) (i.e., the hydroxyl group-containing (co)polymer and the amino group-containing (co)polymer) include the following hydroxyl group-containing (co)polymers (Y1) to (Y4) and an amino group-containing (co)polymer (Y5).

Alkylene oxide adduct (Y1); products such as those obtained by adding an alkylene oxide (such as ethylene oxide or propylene oxide) to a hydrocarbon polymer obtained by polymerizing any one of the aliphatic unsaturated hydrocarbons (1), the alicyclic unsaturated hydrocarbons (2), the aromatic group-containing unsaturated hydrocarbons (e.g., C2-C36 olefins) (3), and the like in the presence of an ionic polymerization catalyst (such as a sodium catalyst).

Product obtained by hydroboration (Y2); products such as those obtained by hydroboration of hydrocarbon polymers (e.g., the one described in U.S. Pat. No. 4,316,973).

Maleic anhydride-ene-amino alcohol adduct (Y3); products such as those obtained by imidization of a reaction product obtained by an ene reaction between a hydrocarbon polymer having a double bond and maleic anhydride with an amino alcohol.

Product obtained by hydroformylation and hydrogenation (Y4); products such as those obtained by hydroformylation of a hydrocarbon polymer having a double bond, followed by hydrogenation (e.g., the one described in JP-A 63-175096).

Maleic anhydride-ene-ethylene diamine adduct (Y5); products such as those obtained by imidization of a reaction product obtained by an ene reaction between a hydrocarbon polymer having a double bond and maleic anhydride with ethylene diamine.

In terms of HTHS viscosity and viscosity index, the (co)polymers (Y1), (Y2), and (Y3) are preferred among these (co)polymers (Y), with (Y1) being more preferred.

In terms of shear stability and HTHS viscosity, the number average molecular weight of each of these (co) polymers (Y) (i.e., the hydroxyl group-containing (co)polymer and the amino group-containing (co)polymer) is preferably 1,000 to 25,000, more preferably 2,000 to 20,000, particularly preferably 3,000 to 15,000, most preferably 4,000 to 10,000.

In terms of low temperature viscosity of the viscosity index improver and the lubricating oil composition, the crystallization temperature of the (co)polymer (Y) is preferably −40° C. or lower, more preferably −50° C. or lower, particularly preferably −55° C. or lower, most preferably −60° C. or lower.

The crystallization temperature of the (co)polymer (Y) and the (co)polymer (A) (described later) can be measured using a differential scanning calorimeter "Unix (registered trademark) DSC7" (PerkinElmer), and it is a crystallization temperature as observed while isothermally cooling a sample (5 mg) of the (co)polymer (Y) or the (co)polymer (A) from 100° C. to −80° C. at a rate of 10° C./min.

In terms of HTHS viscosity and viscosity index, the (co)polymer (A) of the present invention is preferably a copolymer containing a monomer (b) represented by the following formula (2) as a monomer unit:

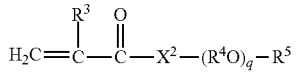

(2)

wherein $R^3$ is a hydrogen atom or a methyl group; —$X^2$— is a group represented by —O— or —NH—; $R^4$ is a C2-C4 alkylene group; $R^5$ is a C1-C8 alkyl group; and q is an integer of 1 to 20 in which each $R^4$ may be the same or different when q is 2 or more, and the $(R^4O)_q$ moieties may be randomly bonded or block-bonded.

In the formula (2), $R^3$ is a hydrogen atom or a methyl group. In terms of viscosity index, a methyl group is preferred between these.

In the formula (2), —$X^2$— is a group represented by —O— or —NH—. In terms of viscosity index, a group represented by —O— is preferred between these.

In the formula (2), $R^4$ is a C2-C4 alkylene group. Examples of the C2-C4 alkylene group include groups such as ethylene, isopropylene, 1,2- or 1,3-propylene, isobutylene, and 1,2-, 1,3-, or 1,4-butylene groups.

In the formula (2), q is an integer of 1 to 20. In terms of viscosity index and low temperature viscosity, q is preferably an integer of 1 to 5, more preferably 1 or 2.

When q is 2 or more, each $R^4$ may be the same or different, and the $(R^4O)_q$ moieties may be randomly bonded or block-bonded.

In the formula (2), $R^5$ is a C1-C8 alkyl group. Specific examples include groups such as methyl, ethyl, n-propyl, isopropyl, n-butyl, isobutyl, t-butyl, n-heptyl, isoheptyl, n-hexyl, 2-ethylhexyl, n-pentyl, and n-octyl groups.

Preferred among these C1-C8 alkyl groups in terms of viscosity index are C1-C6 alkyl groups, with C1-C5 alkyl groups being particularly preferred, and C4 alkyl groups being most preferred.

Specific examples of the monomer (b) include methoxypropyl (meth)acrylate, methoxybutyl (meth)acrylate, methoxyheptyl (meth)acrylate, methoxyhexyl (meth)acrylate, methoxypentyl (meth)acrylate, methoxyoctyl (meth) acrylate, ethoxyethyl (meth)acrylate, ethoxypropyl (meth) acrylate, ethoxybutyl (meth)acrylate, ethoxyheptyl (meth) acrylate, ethoxyhexyl (meth)acrylate, ethoxypentyl (meth) acrylate, ethoxyoctyl (meth)acrylate, propoxymethyl (meth) acrylate, propoxyethyl (meth)acrylate, propoxypropyl (meth)acrylate, propoxybutyl (meth)acrylate, propoxyheptyl (meth)acrylate, propoxyhexyl (meth)acrylate, propoxypentyl (meth)acrylate, propoxyoctyl (meth)acrylate, butoxymethyl (meth)acrylate, butoxyethyl (meth)acrylate, butoxypropyl (meth)acrylate, butoxybutyl (meth)acrylate, butoxyheptyl (meth)acrylate, butoxyhexyl (meth)acrylate, butoxypentyl (meth)acrylate, butoxyoctyl (meth)acrylate, and esters of (meth)acrylic acid and C1-C8 alcohols with 2 to 20 moles of ethylene oxide, propylene oxide, or butylene oxide.

In terms of viscosity index, ethoxyethyl (meth)acrylate and butoxyethyl (meth)acrylate are preferred among the examples of the monomer (b).

In terms of HTHS viscosity in the effective temperature range, the (co)polymer (A) of the present invention is preferably a copolymer containing, as a monomer unit, at least one selected from the group consisting of an alkyl (meth)acrylate (c) having a C1-C4 alkyl group, an alkyl (meth)acrylate (d) having a C12-C36 linear alkyl group, and an alkyl (meth)acrylate (e) having a C12-C36 branched alkyl group, in addition to the monomers (a) and (b).

Examples of the alkyl (meth)acrylate (c) having a C1-C4 alkyl group include methyl (meth)acrylate, ethyl (meth) acrylate, propyl (meth)acrylate, and butyl (meth)acrylate.

In terms of HTHS viscosity and viscosity index, methyl (meth)acrylate and butyl (meth)acrylate are preferred among these examples of the alkyl (meth)acrylate (c), with butyl (meth)acrylate being more preferred.

Examples of the alkyl (meth)acrylate (d) having a C12-C36 linear alkyl group include n-dodecyl (meth)acrylate, n-tridecyl (meth)acrylate, n-tetradecyl (meth)acrylate, n-pentadecyl (meth)acrylate, n-hexadecyl (meth)acrylate, n-octadecyl (meth)acrylate, n-icosyl (meth)acrylate, n-tetracosyl (meth)acrylate, n-triacontyl (meth)acrylate, and n-hexatriacontyl (meth)acrylate.

In terms of HTHS viscosity and viscosity index, alkyl (meth)acrylates having a C12-C32 linear alkyl group are preferred among the examples of the alkyl (meth)acrylate (d), with alkyl (meth)acrylate having a C12-C28 linear alkyl group being more preferred, and alkyl (meth)acrylate having a C12-C22 linear alkyl group being particularly preferred.

The (co)polymer (A) of the present invention may contain a monomer (e) represented by the following formula (3) as a monomer unit:

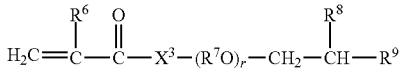

(3)

wherein $R^6$ is a hydrogen atom or a methyl group; —$X^3$— is a group represented by —O— or —NH—; $R^7$ is a C2-C4 alkylene group; $R^8$ and $R^9$ are each independently a C4-C24 linear alkyl group; and r is an integer of 0 to 20 in which each $R^7$ may be the same or different when r is 2 or more, and the $(R^7O)_r$ moieties may be randomly bonded or block-bonded.

In the formula (3), $R^6$ is a hydrogen atom or a methyl group. In terms of viscosity index, a methyl group is preferred between these.

In the formula (3), —$X^3$— is a group represented by —O— or —NH—. In terms of viscosity index, a group represented by —O— is preferred between these.

In the formula (3), $R^7$ is a C2-C4 alkylene group. Examples of the C2-C4 alkylene group include groups such as ethylene, isopropylene, 1,2- or 1,3-propylene, isobutylene, and 1,2-, 1,3-, or 1,4-butylene groups.

In the formula (3), r is an integer of 0 to 20. In terms of viscosity index, it is preferably an integer of 0 to 5, more preferably 0 to 2.

If r is 2 or more, each $R^7$ may be the same or different, and the $(R^7O)_r$ moieties may be randomly bonded or block-bonded.

In the formula (3), $R^8$ and $R^9$ are each independently a C4-C24 linear alkyl group. Specific examples include groups such as n-butyl, n-heptyl, n-hexyl, n-pentyl, n-octyl, n-nonyl, n-decyl, n-undecyl, n-dodecyl, n-tetradecyl, n-hexadecyl, n-octadecyl, n-eicosyl, and n-tetracosyl groups.

In terms of viscosity index, C6-C24 linear alkyl groups are preferred among C4-C24 linear or branched alkyl groups, with C6-C20 linear or branched alkyl groups being more preferred and C8-C16 linear or branched alkyl groups being particularly preferred.

Specific examples of the monomer (e) include 2-octyldecyl (meth)acrylate, an ester of ethylene glycol mono-2-octylpentadecyl ether and a (meth)acrylic acid, 2-octyldodecyl (meth)acrylate, 2-n-decyltetradecyl (meth)acrylate, 2-n-dodecylhexadecyl (meth)acrylate, 2-tetradecyloctadecyl (meth)acrylate, 2-dodecylpentadecyl (meth)acrylate, 2-tetradecylheptadecyl (meth)acrylate, 2-hexadecylheptadecyl (meth)acrylate, 2-heptadecylicosyl (meth)acrylate, 2-hexadecyldocosyl (meth)acrylate, 2-eicosyldocosyl (meth)acrylate, 2-tetracosylhexacosyl (meth)acrylate, and N-2-octyldecyl (meth)acrylamide.

In terms of viscosity index, alkyl (meth)acrylates having a C12-C36 branched alkyl group are preferred among these examples of the monomer (e), with alkyl (meth)acrylates having a C14-C32 branched alkyl group being more preferred, and alkyl (meth)acrylates having a C16-C28 branched alkyl group being particularly preferred.

The monomers (b) to (e) are monomers obtained by reacting a terminal hydroxy group or an amino group of a hydrocarbon-group containing compound with a (meth) acrylic acid but not by modifying a hydrocarbon polymer. Thus, these monomers (b) to (e) are not polyolefin-based monomers. In addition, those obtained by adding 2 to 20 moles of ethylene oxide, propylene oxide, or butylene oxide to C1-C8 alcohols and those obtained by adding 1 to 20 moles of ethylene oxide, propylene oxide, or butylene oxide to C10-C50 branched alkyl group-containing alcohols are also not obtained by modifying hydrocarbon polymers. Thus, these monomers are not polyolefin-based monomers.

In terms of HTHS viscosity in the effective temperature range, the (co)polymer (A) of the present invention is preferably a copolymer further containing, as a monomer unit, at least one selected from the group constituting a nitrogen-containing monomer (f), a hydroxyl group-containing monomer (g), and a phosphorus-containing monomer (h), in addition to the monomers (a) to (e).

Examples of the nitrogen-containing monomer (f) include the following monomers (f1) to (f4), other than the monomers (a), (b), and (e).

Amide group-containing monomer (f1):

Examples include (meth)acrylamides, monoalkyl (meth) acrylamides [those in which one C1-C4 alkyl group is bonded to a nitrogen atom, such as N-methyl (meth)acrylamide, N-ethyl (meth)acrylamide, N-isopropyl (meth)acrylamide, N-n-butyl (meth)acrylamide, and N-isobutyl (meth) acrylamide], N—(N'-monoalkylaminoalkyl)(meth) acrylamides [those having an aminoalkyl group (C2-C6) in which one C1-C4 alkyl group is bonded to a nitrogen atom, such as N—(N'-methylaminoethyl)(meth)acrylamide, N—(N'-ethylaminoethyl)(meth)acrylamide, N—(N'-isopropylamino-n-butyl)(meth)acrylamide, N—(N'-n-butylamino-n-butyl)(meth)acrylamide, and N—(N'-isobutylamino-n-butyl)(meth)acrylamide], dialkyl (meth)acrylamides [those in which two C1-C4 alkyl groups are bonded to a nitrogen atom, such as N,N-dimethyl (meth)acrylamide, N,N-diethyl (meth)acrylamide, N,N-diisopropyl (meth)acrylamide, and N,N-di-n-butyl (meth)acrylamide], N—(N',N'-dialkylaminoalkyl)(meth)acrylamides [those having an aminoalkyl group (C2-C6) in which two C1-C4 alkyl groups are bonded to a nitrogen atom of an aminoalkyl group, such as N—(N',N'-dimethylaminoethyl)(meth)acrylamide, N—(N',N'-diethylaminoethyl)(meth)acrylamide, N—(N',N'-dimethylaminopropyl)(meth)acrylamide, and N—(N',N'-di-n-butylaminobutyl)(meth)acrylamide]; N-vinyl carboxylic acid amides [such as N-vinylformamide, N-vinylacetamide, N-vinyl-n-isopropionic acid amide, N-vinyl-isopropionic acid amide, and N-vinylhydroxyacetamide].

Nitro group-containing monomer (f2):

Examples include 4-nitrostyrene.

Primary to tertiary amino group-containing monomer (f3):

Examples include primary amino group-containing monomers {C3-C6 alkenyl amines [such as (meth)allylamine and crotylamine], and aminoalkyl (C2-C6) (meth)acrylates [such as aminoethyl (meth)acrylate]}; secondary amino group-containing monomers {monoalkylaminoalkyl (meth) acrylates [those having an aminoalkyl group (C2-C6) in which one C1-C6 alkyl group is bonded to a nitrogen atom, such as N-t-butylaminoethyl (meth)acrylate and N-methylaminoethyl (meth)acrylate], and C6-C12 dialkenylamines [such as di(meth)allylamine]}; tertiary amino group-containing monomers {dialkylaminoalkyl (meth)acrylates [those having an aminoalkyl group (C2-C6) in which two C1-C6 alkyl groups are bonded to a nitrogen atom, such as N,N-dimethylaminoethyl (meth)acrylate and N,N-diethylaminoethyl (meth)acrylate], alicyclic (meth)acrylates having a nitrogen atom [such as morpholinoethyl (meth)acrylate], aromatic monomers [such as N—(N',N'-diphenylaminoethyl)(meth)acrylamide, N,N-dimethylaminostyrene, 4-vinylpyridine, 2-vinylpyridine, N-vinylpyrrole, N-vinylpyrrolidone, and N-vinylthiopyrrolidone]}, and hydrochlorides, sulfates, phosphates, and lower alkyl (C1-C8) monocarboxylates (examples of monocarboxylic acids include acetic acid and propionic acid) of these monomers.

Nitrile group-containing monomer (f4):

Examples include (meth)acrylonitrile.

In terms of sludge dispersibility, the monomers (f1) and (f3) are preferred among the monomers (f). More preferred are N—(N',N'-diphenylaminoethyl)(meth)acrylamide, N—(N',N'-dimethylaminoethyl)(meth)acrylamide, N—(N',N'-diethylaminoethyl)(meth)acrylamide, N—(N',N'-dimethylaminopropyl)(meth)acrylamide, N,N-dimethylaminoethyl (meth)acrylate, and N,N-diethylaminoethyl (meth)acrylate.

Hydroxyl group-containing monomer (g):

Examples include hydroxyl group-containing aromatic monomers (such as p-hydroxystyrene), hydroxyalkyl (C2-C6) (meth)acrylates [such as 2-hydroxyethyl (meth)acrylate, and 2- or 3-hydroxypropyl (meth)acrylate], mono- or bis-hydroxyalkyl (C1-C4) substituted (meth)acrylamides [such as N,N-bis(hydroxymethyl)(meth)acrylamide, N,N-bis(hydroxypropyl)(meth)acrylamide, and N,N-bis(2-hydroxybutyl)(meth)acrylamide], vinyl alcohol, C3-C12 alkenols [such as (meth)allyl alcohol, crotyl alcohol, isocrotyl alcohol, 1-octenol, and 1-undecenol], C4-C12 alkene monools or alkene diols [such as 1-buten-3-ol, 2-buten-1-ol, and 2-butene-1,4-diol], hydroxyalkyl (C1-C6) alkenyl (C3-C10) ethers (such as 2-hydroxyethylpropenyl ether), and alkenyl (C3-C10) ethers or (meth)acrylates of polyhydric alcohols having 3 to 8 hydroxyl groups (such as glycerol, pentaerythritol, sorbitol, sorbitan, diglycerol, sugars, and sucrose) [such as (meth)allylether of sucrose].

Examples include polyoxyalkylene glycols (the carbon number of the alkylene group is C2-C4, and the polymerization degree is 2 to 50), polyoxyalkylene polyols [polyoxyalkylene ethers of the polyhydric alcohols having 3 to 8 hydroxyl groups (the carbon number of the alkylene group is C2-C4, and the polymerization degree is 2 to 100)], and mono(meth)acrylates of alkyl (C1-C4) ethers of polyoxyalkylene glycols or polyoxyalkylene polyols [such as polyethylene glycol (Mn: 100 to 300) mono(meth)acrylate, polypropylene glycol (Mn: 130 to 500) mono(meth)acrylate, methoxy polyethylene glycol (Mn: 110 to 310) (meth) acrylate, lauryl alcohol ethylene oxide adduct (2 to 30 moles) (meth)acrylate, and polyoxyethylene (Mn: 150 to 230) sorbitan mono(meth)acrylate].

Examples of the phosphorus-containing monomer (h) include the following monomers (h1) and (h2).

Phosphate group-containing monomer (h1):

Examples include (meth)acryloyloxyalkyl (C2-C4) phosphate esters [such as (meth)acryloyloxyethyl phosphate and (meth)acryloyloxy isopropyl phosphate] and alkenyl phosphate esters [such as vinyl phosphate, allyl phosphate, propenyl phosphate, isopropenyl phosphate, butenyl phosphate, pentenyl phosphate, octenyl phosphate, decenyl phosphate, and dodecenyl phosphate]. The term "(meth)acryloyloxy" means acryloyloxy or methacryloyloxy.

Phosphono group-containing monomer (h2):

Examples include (meth)acryloyloxy alkyl (C2-C4) phosphonic acids [such as (meth)acryloyloxyethyl phosphonic acid] and alkenyl (C2-C12) phosphonic acids [such as vinylphosphonic acid, allylphosphonic acid, and octenylphosphonic acid].

In terms of coefficient of friction with the metal surface, the monomer (h1) is preferred among the monomers (h), with (meth)acryloyloxyalkyl (C2-C4) phosphate esters being more preferred, and (meth)acryloyloxyethyl phosphate being particularly preferred.

In terms of HTHS viscosity in the effective temperature range, the (co)polymer (A) is preferably a copolymer further containing a monomer (i) having two or more unsaturated groups as a monomer unit, in addition to the monomers (a) to (h).

Examples of the monomer (i) having two or more unsaturated groups include divinyl benzene, C4-C12 alkadienes (such as butadiene, isoprene, 1,4-pentadiene, 1,6-heptadiene, and 1,7-octadiene), (di)cyclopentadiene, vinylcyclohexene and ethylidenebicycloheptene, limonene, ethylene di(meth)acrylate, polyalkylene oxide glycol di(meth)acrylate, pentaerythritol triallyl ether, trimethylolpropane tri (meth)acrylate, and esters disclosed in International Publication WO 01/009242 such as an ester of an unsaturated carboxylic acid having an Mn of 500 or more and glycol and an ester of an unsaturated alcohol and a carboxylic acid.

The (co)polymer (A) may contain the following monomers (j) to (p) as monomer units, in addition to the monomers (a) to (i).

Aliphatic hydrocarbon-based monomer (j):

Examples include C2-C20 alkenes (such as ethylene, propylene, butene, isobutylene, pentene, heptene, diisobutylene, octene, dodecene, and octadecene).

Alicyclic hydrocarbon-based monomer (k):

Examples include cyclopentene, cyclohexene, cycloheptene, cyclooctene, and pinene.

Aromatic hydrocarbon-based monomer (l):

Examples include styrene, α-methylstyrene, vinyl toluene, 2,4-dimethylstyrene, 4-ethylstyrene, 4-isopropylstyrene, 4-butylstyrene, 4-phenylstyrene, 4-cyclohexylstyrene, 4-benzylstyrene, 4-crotylbenzene, indene, and 2-vinylnaphthalene.

Vinyl esters, vinyl ethers, vinyl ketones (m):

Examples include vinyl esters of C2-C12 saturated fatty acids (such as vinyl acetate, vinyl propionate, vinyl butyrate, and vinyl octanoate), C1-C12 alkyl, aryl or alkoxyalkylvinyl ether (methyl vinyl ether, ethyl vinyl ether, propyl vinyl ether, butyl vinyl ether, 2-ethylhexyl vinyl ether, phenyl vinyl ether, vinyl-2-methoxyethyl ether, and vinyl-2-butoxyethyl ether), and C1-C8 alkyl or aryl vinyl ketones (such as methyl vinyl ketone, ethyl vinyl ketone, and phenyl vinyl ketone).

Epoxy group-containing monomer (n):

Examples include glycidyl (meth)acrylate and glycidyl (meth)allyl ether.

Halogen-containing monomer (o):

Examples include vinyl chloride, vinyl bromide, vinylidene chloride, (meth)allyl chloride, and halogenated styrene (such as dichlorostyrene).

Ester of unsaturated polycarboxylic acid (p):

Examples include alkyl, cycloalkyl, or aralkyl esters of unsaturated polycarboxylic acids [C1-C8 alkyl diesters (dimethyl maleate, dimethyl fumarate, diethyl maleate, and dioctylmaleate) of unsaturated dicarboxylic acids (such as maleic acid, fumaric acid, and itaconic acid)].

In terms of HTHS viscosity in the effective temperature range, the amount of the monomer (a) constituting the (co)polymer (A) is preferably 1 to 50% by weight, more preferably 5 to 40% by weight, particularly preferably 8 to 40% by weight, most preferably 10 to 30% by weight, based on the weight of the (co)polymer (A).

In terms of HTHS viscosity in the effective temperature range, the amount of the monomer (b) constituting the (co)polymer (A) is preferably 1 to 80% by weight, more preferably 5 to 60% by weight, particularly preferably 10 to 35% by weight, most preferably 10 to 30% by weight, based on the weight of the (co)polymer (A).

In terms of HTHS viscosity in the effective temperature range, the total amount of the monomers (a) and (b) constituting the (co)polymer (A) is preferably 10% by weight or more, more preferably 15 to 90% by weight, particularly preferably 20 to 80% by weight, most preferably 20 to 50% by weight, based on the weight of the (co)polymer (A).

In terms of HTHS viscosity in the effective temperature range, the amount of the alkyl (meth)acrylate (c) constituting the (co)polymer (A) is preferably 1 to 80% by weight, more preferably 20 to 70% by weight, particularly preferably 30 to 65% by weight, based on the weight of the (co)polymer (A).

In terms of HTHS viscosity in the effective temperature range, the amount of the alkyl (meth)acrylate (d) constituting the (co)polymer (A) is preferably 1 to 40% by weight, more preferably 1 to 35% by weight, particularly preferably 2 to 30% by weight, based on the weight of the (co)polymer (A).

In terms of HTHS viscosity in the effective temperature range and low temperature viscosity, the amount of the monomer (e) constituting the (co)polymer (A) is preferably 0 to 40% by weight, more preferably 1 to 30% by weight, particularly preferably 1 to 25% by weight, based on the weight of the (co)polymer (A).

In terms of HTHS viscosity in the effective temperature range and low temperature viscosity, the amount of each of the monomers (f) to (h) constituting the (co)polymer (A) is preferably 0 to 15% by weight, more preferably 1 to 12% by weight, particularly preferably 2 to 10% by weight, based on the weight of the (co)polymer (A).

In terms of HTHS viscosity in the effective temperature range, the amount of the monomer (i) constituting the (co)polymer (A) is preferably 0.01 to 200 ppm, more preferably 0.05 to 50 ppm, particularly preferably 0.1 to 20 ppm, based on the weight of the (co)polymer (A).

In terms of viscosity index and low temperature viscosity, the amount of each of the monomers (j) to (p) constituting the (co)polymer (A) is preferably 0 to 10% by weight, more preferably 1 to 7% by weight, particularly preferably 2 to 5% by weight, based on the weight of the (co)polymer (A).

In the present invention, the solubility parameter (hereinafter abbreviated to SP) of the (co)polymer (A) is not limited as long as the absolute value of the difference in SP between the (co)polymer A and the base oil is 0.8 to 2.0. For example, the solubility parameter may be 5.8 to 11.5 $(cal/cm^3)^{1/2}$.

If the SP of the (co)polymer (A) is outside the above range, the (co)polymer (A) may not be sufficiently dissolved in the base oil. For example, even if the (co)polymer (A) was sufficiently dissolved in the base oil, the HTHS viscosity and the viscosity index might be low.

The SP of the (co)polymer (A) and the SP of each base oil (described later) are values calculated by the Fedors method (described in Polymer Engineering and Science, February, 1974, Vol. 14, No. 2, pp. 147-154).

In terms of viscosity index and solubility in the base oil, the SP of the (co)polymer (A) is preferably 9.1 to 10.3 $(cal/cm^3)^{1/2}$, more preferably 9.1 to 9.7 $(cal/cm^3)^{1/2}$, particularly preferably 9.1 to 9.5 $(cal/cm^3)^{1/2}$, most preferably 9.1 to 9.3 $(cal/cm^3)^{1/2}$.

The SP of the (co)polymer (A) is a value determined by calculating the SP of each monomer constituting the (co)polymer (A) and averaging the SPs of these monomers based on the molar fraction of each monomer unit.

The SP of the (co)polymer (A) can be adjusted by suitably adjusting the SP and the molar fraction of the monomers to be used.

In terms of HTHS viscosity in the effective temperature range and low temperature viscosity, the Mw of the (co)polymer (A) is preferably 5,000 to 2,000,000. A more preferred range varies depending on the application of the viscosity index improver and the lubricating oil composition. Table 1 shows such ranges.

TABLE 1

| Application | More preferred range | Still more preferred range | Particularly preferred range |
|---|---|---|---|
| Engine oil | 150,000 to 1,000,000 | 230,000 to 1,000,000 | 300,000 to 800,000 |
| ATF*, belt-CVTF**, gear oil, MTF*** | 5,000 to 150,000 | 10,000 to 80,000 | 12,000 to 55,000 (most preferably 15,000 to 50,000) |
| Traction oil | 10,000 to 600,000 | 12,000 to 230,000 | 15,000 to 150,000 |

*Automatic transmission fluid
**Belt-continuously variable transmission fluid
***Manual transmission fluid In terms of low temperature viscosity of the viscosity index improver and the lubricating oil composition, the crystallization temperature of the (co)polymer (A) is preferably −30° C. or lower, more preferably −40° C. or lower, particularly preferably −50° C. or lower, most preferably −60° C. or lower.

The (co)polymer (A) can be obtained by a known production method. Specific examples include a method in which the monomer is subjected to solution-polymerization in a solvent in the presence of a polymerization catalyst.

Examples of the solvent include toluene, xylene, C9-C10 alkylbenzenes, methyl ethyl ketone, and mineral oils.

Examples of the polymerization catalyst include azo catalysts (such as 2,2'-azobis(2-methylbutyronitrile) and 2,2'-azobis(2,4-dimethylvaleronitrile)), peroxide catalysts (such as benzoyl peroxide, cumyl peroxide, and lauryl peroxide), and redox catalysts (such as mixtures of benzoyl peroxide and tertiary amines). If necessary, a known chain transfer agent (such as C2-C20 alkylmercaptans) can also be used.

In terms of industrialization, the polymerization temperature is preferably 25° C. to 140° C., more preferably 50° C. to 120° C. The (co)polymer (A) can also be obtained by bulk polymerization, emulsion polymerization, or suspension polymerization other than the solution polymerization.

If the (co)polymer (A) is a copolymer, it may be any of the following types: a random addition polymer, an alternating copolymer, a graft copolymer, and a block copolymer.

The viscosity index improver of the present invention may contain, in addition to the (co)polymer (A) and the base oil, an alkyl (meth)acrylate (co)polymer (B) other than the (co)polymer (A).

The alkyl (meth)acrylate (co)polymer (B) is not limited as long as it is an alkyl (meth)acrylate (co)polymer other than the (co)polymer (A). Examples include alkyl (meth)acrylate (co)polymers having a C1-C18 linear alkyl group.

Specific examples of the alkyl (meth)acrylate (co)polymer (B) include n-octadecyl methacrylate/n-dodecyl methacrylate (molar ratio: 10-30/90-70) copolymer, n-tetradecyl methacrylate/n-dodecyl methacrylate (molar ratio: 10-30/90-70) copolymer, n-hexadecyl methacrylate/n-dodecyl methacrylate/methyl methacrylate (molar ratio: 20-40/55-75/0-10) copolymer, and n-dodecyl acrylate/n-dodecyl methacrylate (molar ratio: 10-40/90-60) copolymer. These may be used alone or in combination of two or more thereof.

In the case where the (co)polymers (A) and (B) are used in combination, in terms of low temperature viscosity, the amount of the (co)polymer (B) to be used is preferably 0.01 to 30% by weight, more preferably 0.01 to 20% by weight, particularly preferably 0.01 to 10% by weight, based on the weight of the (co)polymer (A).

The base oil constituting the lubricating oil composition of the present invention may be any type as long as the absolute value of the difference in solubility parameter between the base oil and the (co)polymer (A) is 0.8 to 2.0 $(cal/cm^3)^{1/2}$. Examples include mineral oils (such as solvent-refined oil, paraffin oil, high viscosity index oil containing isoparaffin, high viscosity index oil obtained by hydrogenolysis of isoparaffin, and naphthene oil), synthetic lubricating oils [for example, hydrocarbon-based synthetic lubricating oils (such as poly-α-olefin-based synthetic lubricating oil), and ester-based synthetic lubricating oils], and mixtures of these oils. In terms of oxidation stability, mineral oils are preferred among these.

The SP of the base oil is not limited as long as the absolute value of the difference between in SP between the (co)polymer (A) and the base oil is 0.8 to 2.0 $(cal/cm^3)^{1/2}$. Preferably, the SP of the base oil is 7.8 to 9.5 $(cal/cm^3)^{1/2}$. If the base oil has an SP of less than 7.8 $(cal/cm^3)^{1/2}$, the HTHS viscosity and the viscosity index tend to be low. If the base oil has an SP of more than 9.5 $(cal/cm^3)^{1/2}$, the solubility of the (co)polymer (A) in such a base oil may be insufficient.

The SP of the base oil is more preferably 7.9 to 9.0 $(cal/cm^3)^{1/2}$, still more preferably 8.0 to 8.5 $(cal/cm^3)^{1/2}$, particularly preferably 8.0 to 8.3 $(cal/cm^3)^{1/2}$, most preferably 8.3 $(cal/cm^3)^{1/2}$.

The SP of the base oil can be adjusted by the type and amount of ester oil.

In terms of HTHS viscosity in the effective temperature range, the kinematic viscosity of the base oil at 100° C. (as measured in accordance with JIS-K2283) is preferably 1 to 15 $mm^2/s$, more preferably 2 to 5 $mm^2/s$.

In terms of HTHS viscosity in the effective temperature range, the viscosity index (as measured in accordance with JIS-K2283) of the base oil is preferably 100 or more, more preferably 110 or more.

The cloud point (as measured in accordance with JIS-K2269) of the base oil is preferably −5° C. or lower, more preferably −15° C. or lower. If the cloud point of the base oil is in the above range, the viscosity index improver and the lubricating oil composition will have good low temperature viscosity.

In terms of kinematic viscosity of the viscosity index improver, the amount of the (co)polymer (A) in the viscosity index improver of the present invention is preferably 1 to 30% by weight as converted into the weight of the (co)polymer (A) in the viscosity index improver, based on the weight of the base oil.

In the case of using the lubricating oil composition as an engine oil, the lubricating oil composition preferably contains 2 to 10% by weight of the (co)polymer (A) in a base oil having a kinematic viscosity at 100° C. of 4 to 10 $mm^2/s$.

In the case of using the lubricating oil composition as a gear oil, the lubricating oil composition preferably contains 3 to 30% by weight of the (co)polymer (A) in a base oil having a kinematic viscosity at 100° C. of 2 to 10 $mm^2/s$.

In the case of using the lubricating oil composition as an automatic transmission fluid (such as ATF or belt-CVTF), the lubricating oil composition preferably contains 3 to 25% by weight of the (co)polymer (A) in a base oil having a kinematic viscosity at 100° C. of 2 to 6 $mm^2/s$.

In the case of using the lubricating oil composition as a traction fluid, the lubricating oil composition preferably contains 0.5 to 10% by weight of the (co)polymer (A) in a base oil having a kinematic viscosity at 100° C. of 1 to 5 $mm^2/s$.

Since the viscosity index improver of the present invention contains a base oil, the viscosity index improver of the present invention itself can function as a lubricating oil composition depending on the mixing ratio of the (co)polymer (A) to the base oil, but it is described as a viscosity index improver so as to distinguish the viscosity index improver from a lubricating oil composition containing at least one additional additive (described later).

The lubricating oil composition of the present invention contains, in addition to the viscosity index improver of the present invention, at least one of the following various additives. Examples of additives are described below.

(1) Detergent:

Examples include basic, overbased, or neutral metal salts [such as overbased metal salts or alkaline earth metal salts of sulfonates (such as petroleum sulfonate, alkylbenzene sulfonate, and alkylnaphthalene sulfonate)], salicylates, phenates, naphthanates, carbonates, phosphonates, and mixtures of these detergents.

(2) Dispersant:

Examples include succinimides (bis- or mono-polybutenyl succinimides), Mannich condensates, and borates;

(3) Antioxidant:

Examples include hindered phenols and aromatic secondary amines.

(4) Oiliness improver:

Examples include long-chain fatty acids and their esters (such as oleic acid and its ester), long-chain amines and their amides (such as oleylamine and oleylamide).

(5) Friction and wear modifier:

Examples include molybdenum-based compounds and zinc-based compounds (such as molybdenum dithiophosphate, molybdenum dithiocarbamate, and zinc dialkyldithiophosphate).

(6) Extreme pressure additive:

Examples include sulfur-based compounds (mono- or disulfide, sulfoxide, and sulfur phosphide compounds), phosphide compounds, and chlorinated compounds (such as chlorinated paraffin).

(7) Defoamer:

Examples include silicone oils, metallic soap, fatty acid ester, and phosphate compounds.

(8) Demulsifier:

Examples include quaternary ammonium salts (such as tetraalkylammonium salt), sulfonated oil, and phosphates (such as phosphates of polyoxyethylene-containing nonionic surfactants).

(9) Corrosion inhibitor:

Examples include nitrogen-containing compounds (such as benzotriazole and 1,3,4-thiadiazolyl-2,5-bisdialkyldithiocarbamate).

Each of these additives is referred to as a component additive, and a mixture of two or more of these component additives is sometimes referred to as a package additive.

EXAMPLES

The present invention is described in detail below with reference to examples, but the present invention is not limited to these examples.

Production Example 1

A reaction vessel equipped with a temperature adjuster, a vacuum stirrer blade, a nitrogen inlet, and a nitrogen outlet was charged with polybutene having an unsaturated group at an end [product name "Polybutene 10N"; NOF Corporation; Mn: 1,000] (280 parts by weight), a 1 mol/L solution of tetrahydrofuran-boron•tetrahydrofuran [Wako Pure Chemical Industries, Ltd.] (400 parts by weight), and tetrahydrofuran (400 parts by weight), and hydroboration was carried out at 25° C. for 4 hours. Subsequently, water (50 parts by weight), a 3N—NaOH aqueous solution (50 parts by volume), and a 30% by weight hydrogen peroxide (50 parts by volume) were added for oxidation. The supernatant was collected in a separating funnel, and the temperature was raised to 50° C. Then, tetrahydrofuran was removed over 2 hours under reduced pressure (in the range of 0.027 to 0.040 MPa) at the same temperature. Thus, a hydroxyl group-containing polymer (Y2-1) was obtained. The total number of isobutylene and 1,2-butylene based on the total number of structural units of the polymer (Y2-1) was 100 mol %, and the crystallization temperature of the polymer (Y2-1) was −60° C. or lower.

Production Example 2

A SUS pressure-resistant reaction vessel equipped with a temperature adjuster and a stirrer was charged with polybutene having an unsaturated group at an end [product name "Polybutene 200N"; NOF Corporation; Mn: 2,650] (530 parts by weight) and maleic anhydride [Wako Pure Chemical Industries, Ltd.] (25 parts by weight), and the temperature was raised to 220° C. while stirring. Then, an ene reaction was carried out for 4 hours at the same temperature. Subsequently, the temperature was cooled to 25° C., and 2-aminoethanol (20 parts by weight) was added. The temperature was raised to 130° C. while stirring. Then, an imidization reaction was carried out for 4 hours at the same temperature. An unreacted maleic anhydride and 2-amino alcohol were removed over 2 hours under reduced pressure (in the range of 0.027 to 0.040 MPa) at a temperature of 120° C. to 130° C. Thus, a hydroxyl group-containing polymer (Y3-1) was obtained. The total number of isobutylene and 1,2-butylene based on the total number of structural units of the polymer (Y3-1) was 100 mol %, and the crystallization temperature of the polymer (Y3-1) was −60° C. or lower.

Examples 1 to 8, Comparative Examples 1 to 6

A reaction vessel equipped with a stirrer, a heating and cooling device, a thermometer, and a nitrogen inlet tube was charged with a base oil A (SP: 8.3 $(cal/cm^3)^{1/2}$; kinematic viscosity at 100° C.: 4.2 $mm^2/s$; viscosity index: 128) (400 parts by weight), a monomer mixture described in Table 2 (100 parts by weight), 2,2'-azobis(2,4-dimethyl valeronitrile) (0.5 parts by weight), and 2,2'-azobis(2-methylbutyronitrile) (0.2 parts by weight), and the reaction vessel was purged with nitrogen (gas-phase oxygen concentration: 100 ppm). Subsequently, the temperature was raised to 76° C. while stirring under hermetically sealed conditions, and a polymerization reaction was carried out for 4 hours at the same temperature. After the temperature was raised to 120° C. to 130° C., an unreacted monomer was removed over 2 hours under reduced pressure (in the range of 0.027 to 0.040 MPa) at the same temperature. Thus, viscosity index improvers (R1) to (R8) and (S1) to (S6) containing copolymers (A1) to (A14) (respectively) and a base oil were obtained. The SP of each of these copolymers (A1) to (A14) was calculated by the method described above, and the Mw was measured by the method described above. The solubility of each copolymer in the base oil was evaluated by the following method. Table 2 shows the results.

<Method for Evaluating the Solubility of the Copolymer in the Base Oil>

The appearance of each of the viscosity index improvers (R1) to (R8) and (S1) to (S6) was visually observed, and the solubility in the base oil was evaluated based on the following criteria.

[Criteria]

Good: Uniform appearance with no insoluble fractions of the copolymer

Poor: Non-uniform appearance with insoluble fractions of the copolymer

TABLE 2

| | Example | | | | | | | |
|---|---|---|---|---|---|---|---|---|
| | 1 | 2 | 3 | 4 | 5 | 6 | 7 | 8 |
| Viscosity index improver | (R1) | (R2) | (R3) | (R4) | (R5) | (R6) | (R7) | (R8) |
| Copolymer | (A1) | (A2) | (A3) | (A4) | (A5) | (A6) | (A7) | (A8) |
| (a1-1) | 10 | 20 | 5 | 15 | 12 | 30 | 0 | 40 |
| (a1-2) | 0 | 0 | 0 | 0 | 0 | 0 | 5 | 0 |
| (a1-3) | 0 | 0 | 0 | 10 | 0 | 0 | 0 | 0 |
| (b-1) | 0 | 0 | 0 | 15 | 0 | 0 | 5 | 0 |
| (b-2) | 20 | 10 | 20 | 5 | 60 | 5 | 50 | 2 |
| (c-1) | 10 | 0 | 0 | 10 | 0 | 10 | 0 | 40 |
| (c-2) | 30 | 60 | 50 | 35 | 0 | 45 | 0 | 0 |
| (d-1) | 15 | 10 | 0 | 7 | 10 | 5 | 10 | 10 |
| (d-2) | 5 | 0 | 0 | 3 | 8 | 0 | 0 | 0 |
| (d-3) | 0 | 0 | 0 | 0 | 0 | 2 | 10 | 5 |
| (e-1) | 0 | 0 | 0 | 0 | 10 | 0 | 0 | 0 |
| (e-2) | 10 | 0 | 25 | 0 | 0 | 0 | 10 | 0 |
| (f-1) | 0 | 0 | 0 | 0 | 0 | 3 | 0 | 0 |
| (g-1) | 0 | 0 | 0 | 0 | 0 | 0 | 10 | 0 |
| (h-1) | 0 | 0 | 0 | 0 | 0 | 0 | 0 | 3 |
| Subtotal | 100 | 100 | 100 | 100 | 100 | 100 | 100 | 100 |
| Total amount of (A) and (b) | 30 | 30 | 25 | 45 | 72 | 35 | 60 | 42 |
| SP of (A) | 9.20 | 9.16 | 9.19 | 9.13 | 9.14 | 9.10 | 9.55 | 9.12 |
| Solubility in base oil | Good | Good | Good | Good | Good | Good | Good | Good |
| Absolute value of difference in SP between (A) and base oil | 0.90 | 0.86 | 0.89 | 0.83 | 0.84 | 0.80 | 1.25 | 0.82 |
| Crystallization temp. of (A) | −60° C. or lower | −60° C. or lower | −60° C. or lower | −60° C. or lower | −60° C. or lower | −60° C. or lower | −60° C. or lower | −60° C. or lower |
| Mw of (A) and (H) ($\times 10^4$) | 49 | 45 | 45 | 46 | 35 | 32 | 40 | 46 |

| | Comparative Example | | | | | |
|---|---|---|---|---|---|---|
| | 1 | 2 | 3 | 4 | 5 | 6 |
| Viscosity index improver | (S1) | (S2) | (S3) | (S4) | (S5) | (S6) |
| Copolymer | (A9) | (A10) | (A11) | (A12) | (A13) | (A14) |
| (a1-1) | 25 | 15 | 0 | 25 | 52 | 0 |
| (a1-2) | 0 | 0 | 0 | 0 | 0 | 0 |
| (a1-3) | 0 | 0 | 0 | 0 | 0 | 0 |
| (b-1) | 0 | 0 | 0 | 0 | 10 | 0 |
| (b-2) | 0 | 10 | 20 | 0 | 0 | 0 |
| (c-1) | 0 | 30 | 20 | 35 | 0 | 36 |
| (c-2) | 53 | 0 | 0 | 0 | 33 | 0 |
| (d-1) | 17 | 0 | 30 | 0 | 5 | 0 |
| (d-2) | 5 | 17 | 0 | 0 | 0 | 0 |
| (d-3) | 0 | 0 | 0 | 30 | 0 | 32 |
| (e-1) | 0 | 0 | 30 | 10 | 0 | 32 |
| (e-2) | 0 | 0 | 0 | 0 | 0 | 0 |
| (f-1) | 0 | 0 | 0 | 0 | 0 | 0 |
| (g-1) | 0 | 28 | 0 | 0 | 0 | 0 |
| (h-1) | 0 | 0 | 0 | 0 | 0 | 0 |
| Subtotal | 100 | 100 | 100 | 100 | 100 | 100 |
| Total amount of (A) and (b) | 25 | 25 | 20 | 25 | 62 | 0 |
| SP of (A) | 9.06 | 10.36 | 9.18 | 9.07 | 8.84 | 9.19 |
| Solubility in base oil | Good | Poor | Good | Good | Good | Good |
| Absolute value of difference in SP between (A) and base oil | 0.76 | 2.06 | 0.88 | 0.77 | 0.54 | 0.89 |
| Crystallization temp. of (A) | −60° C. or lower | −60° C. or lower | −50° C. | −60° C. or lower | −60° C. or lower | −40° C. |
| Mw of (A) and (H) ($\times 10^4$) | 45 | 46 | 40 | 52 | 39 | 50 |

The compositions of the monomers (a) to (h) described in Table 2 are as follows.

(Y1-1): Polymer (hydrogenated polybutadiene) having a hydroxyl group at one end (product name "Krasol HLBH-5000M"; Cray Valley; proportion of 1,2-butylene: 65 mol %; hydroxyl value; 10.4 mg KOH/g) [total number of isobutylene and 1,2-butylene based on the total number of structural units of the polymer (Y1-1): 65 mol %; crystallization temperature of the polymer (Y1-1): −60° C. or lower]

(Y2-1): Product obtained by hydroboration of polybutene having an unsaturated group at one end described in Production Example 1

(Y3-1): Maleic anhydride-ene-amino alcohol adduct of polybutene having an unsaturated group at one end described in Production Example 2

(a1-1): Product obtained by esterification of methacrylic acid of the polymer (Y1-1) [Mn: 5,000]

(a1-2): Product obtained by esterification of methacrylic acid of the polymer (Y2-1) [Mn: 1,100]

(a1-3): Product obtained by esterification of methacrylic acid of the polymer (Y3-1) [Mn: 3,000]

(b-1): Ethoxyethyl methacrylate (b-2): Butoxyethyl methacrylate (c-1): Methyl methacrylate (c-2): Butyl methacrylate (d-1): N-dodecyl methacrylate (d-2): N-tetradecyl methacrylate (d-3): N-hexadecyl methacrylate (e-1): 2-N-decyltetradecyl methacrylate (e-2): 2-N-dodecylhexadecyl methacrylate (f-1): N,N-dimethylaminoethyl methacrylate (g-1): 2-Hydroxyethyl methacrylate (h-1): Methacryloyloxyethyl phosphate

Examples 9 to 16 and Comparative Examples 7 to 12

0W-20 Evaluation

A stainless steel vessel equipped with a stirrer was charged with a base oil A (SP: 8.3 $(cal/cm^3)^{1/2}$; kinematic viscosity at 100° C.: 4.2 $mm^2/s$; viscosity index: 128) (90 parts) and a package additive (Infineum P5741) (10 parts). Subsequently, the viscosity index improvers (R1) to (R8) and (S1) to (S6) were separately added to obtain lubricating oil compositions having a HTHS viscosity at 150° C. of 2.60±0.05 ($mm^2/s$). Thus, lubricating oil compositions (V1) to (V8) and (W1) to (W6) were obtained.

The lubricating oil compositions (V1) to (V8) and (W1) to (W6) were measured for shear stability, HTHS viscosity (100° C.), HTHS viscosity (80° C.), viscosity index, and low temperature viscosity (−40° C.) by the following methods. Table 3 shows the results.

In Comparative Example 8 in which the viscosity index improver (S2) was added, it was not possible to add the viscosity index improver (S2) in a sufficient amount to obtain an intended HTHS viscosity (i.e., the solubility of the viscosity index improver (S2) was insufficient). Thus, the shear stability, HTHS viscosity (100° C.), HTHS viscosity (80° C.), viscosity index, and low temperature viscosity (−40° C.) could not be measured.

Examples 17 to 24 and Comparative Examples 13 to 18

0W-16 Evaluation

A stainless steel vessel equipped with a stirrer was charged with a base oil A (SP: 8.3 $(cal/cm^3)^{1/2}$; kinematic viscosity at 100°: 4.2 $mm^2/s$; viscosity index: 128) (90 parts) and a package additive (Infineum P5741) (10 parts). Subsequently, the viscosity index improvers (R1) to (R8) and (S1) to (S6) were added to obtain lubricating oil compositions having a HTHS viscosity at 150° C. of 2.30±0.05 ($mm^2/s$). Thus, lubricating oil compositions (V9) to (V16) and (W7) to (W12) were obtained.

The lubricating oil compositions (V9) to (V16) and (W7) to (W12) were measured for shear stability, HTHS viscosity (100° C.), HTHS viscosity (80° C.), viscosity index, and low temperature viscosity (−40° C.) by the following methods. Table 4 shows the results.

In Comparative Example 14 in which the viscosity index improver (S2) was added, it was not possible to add the viscosity index improver (S2) in a sufficient amount to obtain an intended HTHS viscosity (i.e., the solubility of the viscosity index improver (S2) was insufficient). Thus, the shear stability, HTHS viscosity (100° C.), HTHS viscosity (80° C.), viscosity index, and low temperature viscosity (−40° C.) could not be measured.

<Methods for Measuring and Calculating the Shear Stability of the Lubricating Oil Composition>

The method of ASTM D 6278 was used for measurement and the method of ASTM D 6022 was used for calculation.

<Method for Measuring the HTHS Viscosity of the Lubricating Oil Composition>

The method of ASTM D 5481 was used for measurement at 80° C. and 100° C.

<Method for Calculating the Viscosity Index of the Lubricating Oil Composition>

The method of ASTM D 445 was used to measure the kinematic viscosity at 40° C. and 100° C., and the method of ASTM D 2270 was used for calculation.

<Method for Measuring the Low Temperature Viscosity of the Lubricating Oil Composition>

The method of JPI-5S-42-2004 was used to measure the viscosity at −40° C.

TABLE 3

| | Example | | | | | | | |
|---|---|---|---|---|---|---|---|---|
| | 9 | 10 | 11 | 12 | 13 | 14 | 15 | 16 |
| Viscosity index improver | (R1) | (R2) | (R3) | (R4) | (R5) | (R6) | (R7) | (R8) |
| Lubricating oil composition | (V1) | (V2) | (V3) | (V4) | (V5) | (V6) | (V7) | (V8) |
| Shear stability (%) | 7 | 6 | 7 | 7 | 8 | 9 | 9 | 9 |
| HTHS viscosity (100° C.) (mPa · s) | 4.73 | 4.75 | 4.85 | 4.83 | 4.93 | 4.93 | 4.91 | 4.91 |
| HTHS viscosity (80° C.) (mPa · s) | 7.05 | 7.10 | 7.21 | 7.18 | 7.20 | 7.20 | 7.18 | 7.18 |
| Viscosity index | 238 | 239 | 236 | 234 | 235 | 234 | 234 | 236 |
| Low-temperature viscosity (−40° C.) | 25,000 | 22,000 | 23,000 | 28,000 | 22,000 | 18,000 | 23,000 | 21,000 |

TABLE 3-continued

| | Comparative Example | | | | | |
|---|---|---|---|---|---|---|
| | 7 | 8 | 9 | 10 | 11 | 12 |
| Viscosity index improver | (S1) | (S2) | (S3) | (S4) | (S5) | (S6) |
| Lubricating oil composition | (W1) | (W2) | (W3) | (W4) | (W5) | (W6) |
| Shear stability (%) | 12 | Not evaluable | 20 | 12 | 6 | 25 |
| HTHS viscosity (100° C.) (mPa · s) | 5.05 | | 4.95 | 5.09 | 5.30 | 4.83 |
| HTHS viscosity (80° C.) (mPa · s) | 7.82 | | 7.35 | 7.65 | 8.02 | 7.25 |
| Viscosity index | 232 | | 212 | 231 | 239 | 210 |
| Low-temperature viscosity (−40° C.) | 35,000 | | 20,000 | 22,000 | 18,000 | 25,000 |

TABLE 4

| | Example | | | | | | | |
|---|---|---|---|---|---|---|---|---|
| | 17 | 18 | 19 | 20 | 21 | 22 | 23 | 24 |
| Viscosity index improver | (R1) | (R2) | (R3) | (R4) | (R5) | (R6) | (R7) | (R8) |
| Lubricating oil composition | (V9) | (V10) | (V11) | (V12) | (V13) | (V14) | (V15) | (V16) |
| Shear stability (%) | 6 | 5 | 6 | 6 | 7 | 8 | 8 | 8 |
| HTHS viscosity (100° C.) (mPa · s) | 4.46 | 4.48 | 4.57 | 4.55 | 4.65 | 4.65 | 4.63 | 4.63 |
| HTHS viscosity (80° C.) (mPa · s) | 6.85 | 6.89 | 7.00 | 6.97 | 6.99 | 6.99 | 6.97 | 6.97 |
| Viscosity index | 238 | 239 | 236 | 234 | 235 | 234 | 234 | 236 |
| Low-temperature viscosity (−40° C.) | 22,000 | 18,500 | 21,000 | 25,000 | 20,000 | 18,000 | 22,000 | 20,000 |

| | Comparative Example | | | | | |
|---|---|---|---|---|---|---|
| | 13 | 14 | 15 | 16 | 17 | 18 |
| Viscosity index improver | (S1) | (S2) | (S3) | (S4) | (S5) | (S6) |
| Lubricating oil composition | (W7) | (W8) | (W9) | (W10) | (W11) | (W12) |
| Shear stability (%) | 11 | Not evaluable | 18 | 10 | 5 | 23 |
| HTHS viscosity (100° C.) (mPa · s) | 4.76 | | 4.95 | 5.09 | 5.30 | 4.83 |
| HTHS viscosity (80° C.) (mPa · s) | 7.59 | | 7.57 | 7.88 | 8.26 | 7.47 |
| Viscosity index | 232 | | 212 | 231 | 239 | 210 |
| Low-temperature viscosity (−40° C.) | 32,000 | | 18,000 | 20,000 | 18,000 | 25,000 |

As shown in the results of Table 3 and Table 4, the lubricating oil compositions (Examples 9 to 16 and Examples 17 to 24) containing the viscosity index improvers of the present invention are excellent in that these compositions have excellent shear stability, a low HTHS viscosity in the effective temperature range, and a high viscosity index. In contrast, the results show that the lubricating oil compositions in Comparative Examples 7 to 12 and Comparative Examples 13 to 18 are poor in at least one of shear stability, HTHS viscosity in the effective temperature range, and viscosity index. In addition, according to the results of Comparative Example 9, Comparative Example 12, Comparative Example 15, and Comparative Example 18, the shear stability is poor in the lubricating oil compositions obtained by using a viscosity index improver containing the copolymer (A) not containing a polyolefin-based monomer as an essential structural unit, even though the absolute value of difference in solubility parameter between the (co)polymer (A) and the base oil is 0.8 to 2.0 in these lubricating oil compositions.

INDUSTRIAL APPLICABILITY

The viscosity index improver of the present invention and the lubricating oil compositions containing the same are suitable as lubricating oils for driving system (such as MTF, differential gear oil, ATF, and belt-CVTF), hydraulic oils (such as hydraulic oil for machines, power steering oil, and shock absorber oil), engine oils (such as oils for gasoline and diesel engines), and traction fluids.

The invention claimed is:

1. A viscosity index improver comprising:

a (co)polymer (A) comprising:

(a) a polyolefin-based monomer unit (a) represented by the following formula (1):

(1)

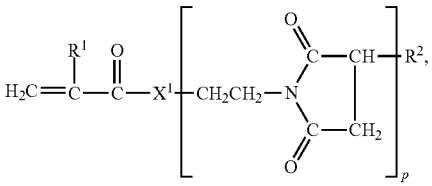

wherein $R^1$ is a hydrogen atom or a methyl group; —$X^1$— is a group represented by —O—, —$O(AO)_m$—, or —NH— in which A is a C2-C4 alkylene group, m is an integer of 0 to 10 each A may be the same or different when m is 2 or more, and the $(AO)_m$ moieties may be randomly bonded or block-bonded; $R^2$ is a residue in which one hydrogen atom is removed from a hydrocarbon polymer containing at least one of isobutylene or 1,2-butylene as an essential structural unit; and p is a number of 0 or 1, and (b) a monomer unit (b) represented by the following formula (2):

(2)

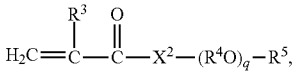

wherein $R^3$ is a hydrogen atom or a methyl group; —$X^2$— is a group represented by —O— or —NH—; $R^4$ is a C2-C4 alkylene group; $R^5$ is a C1-C8 alkyl group; and q is an integer of 1 to 20 in which each $R^4$ may be the same or different when q is 2 or more, and the $(R^4O)_q$ moieties may be randomly bonded or block-bonded; and a base oil, wherein the absolute value of the difference in solubility parameter between the (co)polymer (A) and the base oil is 0.8 to 2.0 $(cal/cm^3)^{1/2}$.

2. The viscosity index improver according to claim 1, wherein the solubility parameter of the base oil is 7.8 to 9.5 $(cal/cm^3)^{1/2}$.

3. The viscosity index improver according to claim 1, wherein the hydrocarbon polymer containing at least one of isobutylene or 1,2-butylene as an essential structural unit in the formula (1) is a polymer in which the total number of isobutylene and 1,2-butylene based on the total number of structural units is 30 mol % or more.

4. The viscosity index improver according to claim 1, wherein the (co)polymer (A) is the copolymer containing, as monomer units, 1 to 50% by weight of the monomer (a) and 1 to 80% by weight of the monomer (b) based on the weight of the (co)polymer (A), with the total amount of the monomers (a) and (b) being 10% by weight or more.

5. The viscosity index improver according to claim 1, wherein the (co)polymer (A) is the copolymer further containing, as a monomer unit, at least one of an alkyl (meth)acrylate (c) having a C1-C4 alkyl group or an alkyl (meth)acrylate (d) having a C12-C36 linear alkyl group.

6. The viscosity index improver according to claim 5, wherein the (co)polymer (A) is the copolymer further containing a monomer (e) represented by the following formula (3) as a monomer unit:

(3)

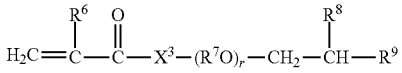

wherein $R^6$ is a hydrogen atom or a methyl group; —$X^3$— is a group represented by —O— or —NH—; $R^7$ is a C2-C4 alkylene group; $R^8$ and $R^9$ are each independently a C4-C24 linear alkyl group; and r is an integer of 0 to 20 in which each $R^7$ may be the same or different when r is 2 or more, and the $(R^7O)_r$ moieties may be randomly bonded or block-bonded.

7. The viscosity index improver according to claim 6, wherein the (co)polymer (A) is the copolymer containing, as monomer units, 5 to 40% by weight of the monomer (a), 5 to 60% by weight of the monomer (b), 1 to 80% by weight of the alkyl (meth)acrylate (c), 1 to 40% by weight of the alkyl (meth)acrylate (d), and 1 to 30% by weight of the monomer (e), based on the weight of the (co)polymer (A).

8. The viscosity index improver according to claim 1, wherein the (co)polymer (A) is a copolymer further comprising, as a monomer unit, at least one selected from the group consisting of a nitrogen-containing monomer (f), a hydroxyl group-containing monomer (g), and a phosphorus-containing monomer (h).

9. The viscosity index improver according to claim 1, wherein the (co)polymer (A) has a weight average molecular weight of 5,000 to 2,000,000.

10. The viscosity index improver according to claim 1, further comprising 0.01 to 30% by weight of a (co)polymer (B) other than the (co)polymer (A), based on the weight of the (co)polymer (A).

11. The viscosity index improver according to claim 1, wherein the base oil has a kinematic viscosity at 100° C. of 1 to 15 $mm^2/s$, and the base oil has a viscosity index of 100 or more.

12. A lubricating oil composition comprising:

the viscosity index improver according to claim 1; and at least one additive selected from the group consisting of a detergent, a dispersant, an antioxidant, an oiliness improver, a friction and wear modifier, an extreme pressure additive, a defoamer, a demulsifier, and a corrosion inhibitor.

* * * * *